United States Patent [19]

Inagaki

[11] Patent Number: 4,594,116

[45] Date of Patent: Jun. 10, 1986

[54] METHOD FOR MANUFACTURING HIGH STRENGTH COPPER ALLOY WIRE

[75] Inventor: Tom Inagaki, LaGrangeville, N.Y.

[73] Assignee: Hudson Wire Company, Ossining, N.Y.

[21] Appl. No.: 635,890

[22] Filed: Jul. 30, 1984

[51] Int. Cl.[4] ..... C22F 1/08

[52] U.S. Cl. ..... 148/12.7 C

[58] Field of Search ..... 148/11.56, 12.7 C, 411, 148/414, 13.2, 160; 420/494, 485

[56] References Cited

U.S. PATENT DOCUMENTS

| | | | |
|---|---|---|---|
| 2,257,708 | 9/1941 | Stott | 148/12.7 C |
| 2,289,593 | 7/1942 | Sawyer et al. | 148/414 |
| 2,406,683 | 8/1946 | Hensel et al. | 148/160 |

FOREIGN PATENT DOCUMENTS

| | | | |
|---|---|---|---|
| 661 | 3/1962 | Japan | 148/11.5 C |
| 163248 | 12/1981 | Japan | 148/414 |
| 621224 | 4/1949 | United Kingdom | 148/12.7 C |

OTHER PUBLICATIONS

Metals Handbook, 9th edition, vol. 2, Properties and Selection: Nonferrous Alloys and Pure Metals, ASM, Metals Park, Ohio, 1979, pp. 271–273, and 308.

McDonald, "A Dispersion Hardened Copper for Electrical Uses, Metal Progress, vol. 89, No. 4, Apr. 1966, pp. 70–72.

Hart, "High Strength Copper Alloys by Thermomechanical Treatments", Metallurgical Transactions, vol. 1, Nov. 1970, pp. 3163–3172.

*Primary Examiner*—Wayland Stallard

*Attorney, Agent, or Firm*—Andrew D. Maslow

[57] ABSTRACT

A method for processing a copper alloy wherein the alloy comprises from 0.2–1.0% beryllium, 1.4–2.2% nickel or cobalt and remainder copper. Said method comprising one or more processing steps and characterized in that said steps conclude with cold working the alloy to an area reduction of at least 99% followed by a batch annealing at a temperature of 750°–950° F. for a period of 1–4 hours.

5 Claims, No Drawings

METHOD FOR MANUFACTURING HIGH STRENGTH COPPER ALLOY WIRE

FIELD OF THE INVENTION

This invention relates to a method of efficiently processing copper-beryllium alloys into fine wire form such that a unique combination of high-strength and high-conductivity with the required elongation is obtained.

BACKGROUND OF THE INVENTION

Copper-beryllium alloys have been well known for many years as having excellent high strength characteristics. These alloys generally containing from 0.2 to 2.0% beryllium with optional additions of 1.0 to 3% nickel or cobalt are classified as precipitation hardenable copper-base alloys.

In precipitation hardenable copper-base alloys, one or more elements, which form a solid solution at elevated temperature but exhibit a decreasing solubility at lower temperatures, are alloyed with copper. The alloy is quenched from the solid solution region producing a supersaturated metastable phase and is subsequently thermally aged such that a second phase is precipitated out of the matrix. These precipitates act to block the motion of dislocations during deformation resulting in the observed strengthening. Further, due to the small amount of alloying elements, high conductivities in relation to strength as compared to traditional alloys can be obtained.

The resultant combination of properties of strength, ductility and conductivity are controlled by the amount, size and distribution of the precipitates. Therefore, the sequence and degree of work hardening and thermal aging which determine the kinetics of precipitation are critical in obtaining the desired properties.

Known processes for manufacturing wire from these copper alloys generally result in product having a tensile strength of 110 ksi and a conductivity of 48% IACS at the required elongation. Due to their superior strength, these alloys have found numerous applications in the connector industry. However, due to the relative low conductivity (pure copper is 100% IACS), conductor applications have been very limited. Further, fine stranded wires which would benefit most from the higher strength characteristics of these alloys cannot be easily processed due to the presence of extremely hard intermetallic precipitates.

Known processes for manufacturing wire from these alloys generally begin with the alloy in the desired precipitation hardened condition. The basic theory being that drawing to final size only acts to work harden the alloy and subsequent annealing will return the alloy to its original desired precipitation hardened condition. However, due to the presence of the extremely hard intermetallic precipitates in the precipitation hardened condition, excessive due wear occurs making wire drawing exceedingly difficult. Because of this, a flash plating of silver on the surface prior to drawing to reduce friction and/or intermediate stress relief anneals must be incorporated into the process to manufacture fine wire. This also limits the degree of cold working possible which significantly affects the final wire properties.

The instant invention provides for a method for manufacturing a fine wire product for signal and control wire applications. Wires manufactured with this process exhibit a surprising combination of tensile strength and electrical conductivity of at least 95 ksi and of 60% IACS respectively with at least 8% elongation in 10 inches. The instant invention further provides a method for efficiently manufacturing fine wires without the use of prior wire surface coatings (silver flash plating) or intermediate annealing treatments as essential processing steps to produce the final product.

U.S. Pat. No. 1,974,839 teaches the use of an alloy of 1–4% beryllium, 1.4–2.7% nickel and the remainder copper. The annealing range which is taught by this patent is from 200° C. to 360° C.

U.S. Pat. No. 2,172,639 discloses an alloy and a process for making an alloy with 24.6% conductivity and cold working of up to 60% reduction in area.

U.S. Pat. No. 3,663,311 discloses the processing of beryllium-copper alloys. None of the above prior art discloses a process for efficiently manufacturing a wire having the combination of strength, ductility and conductivity of the instant invention.

SUMMARY OF THE INVENTION

The objective of the instant invention is to provide a process for making a round or flat wire having a tensile strength of at least 95 ksi while maintaining a conductivity of at least 60% IACS.

A further objective of the instant invention is to provide a process for manufacturing a wire having an elongation of at least 8% in 10 inches while maintaining the above properties.

A still further objective of the invention is to provide a process for efficiently manufacturing fine, geometrically stranded wires having the above properties.

It has been found that, by the treatment of certain beryllium-copper alloys in accordance with the invention, a surprising combination of physical characteristics is obtained. The alloy of the invention is one comprising 0.2–1.0% preferably 0.2–0.6% beryllium, 1.4–2.2% nickel or cobalt and the remainder copper. Alloys within this range are well known and are sold by Brush Wellman, Inc. Cleveland, Ohio and designated as Brush Alloy 3 which is a precipitation hardenable alloy. Table A below indicates the minimum mechanical and electrical properties for Alloy 3, as published by Brush Wellman, Inc.

TABLE A

| Condition | Heat Treatment | Tensile Strength 1000 psi | Yield Strength 0.2% Offset 1000 psi | Elongation % in 2 in. | Hardness Rockwell B or C Scale | Electrical Conductivity % IACS |
|---|---|---|---|---|---|---|
| A | | 35 | 20 | 20 | B20 | 20 |
| H | | 65 | 55 | 10 | B60 | 20 |
| AT | 3 hr. @ 900 ± 25° F. | 100 | 80 | 10 | B92 | 45 |
| HT | 2 hr. @ | 110 | 100 | 10 | B95 | 48 |

TABLE A-continued

| Condi-tion | Heat Treatment | Tensile Strength 1000 psi | Yield Strength 0.2% Offset 1000 psi | Elongation % in 2 in. | Hardness Rockwell B or C Scale | Electrical Conductivity % IACS |
|---|---|---|---|---|---|---|
| | 900 ± 25° F. | | | | | |

REMARKS:
The condition column denotes the temper of the alloy where "A" and "H+ represent solution annealed and hard (37% R.A.) condition respectively and the "T" designation represents thermally aged.

According to the invention, the alloy is cast and processed to redraw wire sizes typically between 0.080 to 0.040 inches preferably 0.050 inches. The alloy is then heated to between 1650° and 1800° F. where most of the alloying elements are in solid solution and rapidly quenched to room temperature to form a supersaturated metastable structure. Optionally, the alloy may then be plated with nickel or silver to obtain additional corrosion resistance and/or solderability characteristics.

While the alloy is in the supersaturated metastable phase, it is drawn directly without intermediate treatments into a fine wire and optionally rolled flat such that the alloy is cold worked in excess of 99% R.A.

As shown in Example 2 this degree of cold working is essential in obtaining the desired combination of properties. This is contrary to known processes which generally limit the degree of cold working to well under 90% R.A. Further, as seen in Example 3, cold working to this degree is only possible when starting with the alloy in the solution heat treated condition. In the fully precipitation hardened condition, the presence of the hard precipitates significantly increases the rate of work hardening and therefore limits the degree of cold working to about 97% R.A. before the alloy becomes brittle. Since known processes generally begin with material in the fully precipitation hardened condition, cold working in excess of 99% cannot be attained which limits the above combination of properties.

The wire then may optionally be stranded to form various geometric (unilay or concentric) or bunched constructions.

The wire is then annealted in a batch system by placing a wire in an atmosphere controlled furnace and heating the furnace to 750°-950° F. preferably 880° F. and maintaining the furnace at such temperature at a pressure in excess of 1 atmosphere for a period of 1-4 hours, preferably 3 hours. The wire is then furnace cooled to about room temperature.

EXAMPLE 1

A 0.050 inch diameter wire of beryllium-copper alloy of composition in weight percent 0.38 beryllium, 1.66 nickel and remainder copper in the solution annealed and quenched condition was cold drawn to 0.0025 inch diameter corresponding to an area reduction of 99.75%. The wires were then stranded into a 19 strand 1-6-12 concentric construction. Equal size samples of the stranded wire were batch annealed at different temperatures in a reducing atmosphere for 3 hours and furnace cooled to room temperature.

Samples were tested in tension for ultimate tensile strength and elongation on an Instron machine utilizing a crosshead speed of 10 in./min. and a gauge length of 10 inches. The conductivity was measured on a Leeds and Northrup Kelvin bridge utilizing a sample length of 5 ft. Results of the example are seen in Table B.

TABLE 1.1

| Sam-ple | Temper-ature °F. | Ultimate Tensile Strength (ksi) | Elongation (% in 10 in.) | Conductivity (% IACS) |
|---|---|---|---|---|
| 1 | 750 | 124.3 | 1.5 | 60.2 |
| 2 | 820 | 120.1 | 3.0 | 63.9 |
| 3 | 880 | 97.6 | 9.0 | 65.2 |

By comparing the results of Table A and Table B it can be seen that by increasing the cold working to greater than 99% R.A., the combination of ultimate tensile strength and conductivity obtained is significantly increased. As seen in Table A thermal treatment after 37% R.A. as represented by condition "HT" results in an ultimate tensile strength of 110 ksi and a conductivity of 48% IACS. Similar thermal treatment after 99.75% R.A., as seen in Table B, Sample 3 results in a tensile strength of 97.6 ksi and a conductivity of 65.2 IACS. This represents a surprising increase in conductivity of 35.8% while exhibiting a decrease in the tensile strength of only 11.3%.

EXAMPLE 2

In order to obtain the desired combination of properties of 95,000 psi minimum tensile strength, 60% IACS conductivity minimum with a minimum of 8% elongation, cold working in excess of 99% R.A. prior to final annealing treatment has been found to be essential.

0.050 inch diameter wire of beryllium-copper alloy of composition in weight percent 0.38 beryllium, 1.66 nickel and remainder copper in the solution annealed and quenched condition was cold drawn to between 0.0020 and 0.0320 inches in diameter corresponding to an area reduction of between 99.84 and 59.00%. Equal size samples of wires were batch annealed at between 880° and 1,000° F. in a reducing atmosphere for 3 hours and furnace cooled to generate a conductivity of approximately 63% IACS.

Samples were tested in tension for ultimate tensile strength and elongation on an Instron machine utilizing a crosshead speed of 10 in./min. The conductivity was measured on a Leeds and Northrup Kelvin bridge utilizing a sample length of 5 ft.

Results of the test are seen in Table 2.1.

TABLE 2.1

| Cold Work (% R.A.) | Tensile Strength (psi) | Conductivity (% IACS) | Elongation (% in. 10 in.) |
|---|---|---|---|
| 99.84 | 112,246 | 65.2 | 8 |
| 99.75 | 97,570 | 65.2 | 9 |
| 99.62 | 96,530 | 64.0 | 9 |
| 99.36 | 97,750 | 63.0 | 9 |
| 99.00 | 95,129 | 63.0 | 9 |
| 97.44 | 83,556 | 63.0 | 7 |
| 83.84 | 85,091 | 61.0 | 10 |
| 59.04 | 84,259 | 61.0 | 7 |

As seen in Table 2.1, the required combination of conductivity and tensile strength are not obtained until the alloy is cold worked in excess of 99% R.A. Further, as the degree of cold working is increased beyond 99% R.A., higher tensile strength and conductivities are obtained such that at 99.84% R.A. an increase in conductivity of 35.8% without any loss in tensile strength is obtained in comparison to results via prior process of Table A.

EXAMPLE 3

Properties of tensile strength and conductivity of alloy manufactured via the conventional known process and the contained modified process were compared. In both processes a beryllium copper alloy, Brush Alloy 3, of composition in weight percent 0.38 beryllium, 1.66 nickel and remainder copper were employed.

In the conventional process the alloy was fully precipitation hardened at 0.50 inch in diameter by annealing at 880° F. for 3 hours in a reducing atmosphere and furnace cooled to room temperature. The wire was then drawn to 0.0025 inches in diameter in 2 steps with an intermediate anneal of 880° F. for 3 hours at 0.008 inches in diameter. This represented a cold working of 97 and 90% R.A. respectively for the first and second drawing steps. An intermediate anneal was necessary due to the brittle nature of the wire beyond 0.008 inches in diameter resulting in excessive wire breakage during drawing. The wire was then stranded in a 19 end 1-6-12 concentric construction and annealed at 880° F. for 3 hours in a reducing atmosphere and furnace cooled to room temperature.

In the modified process, the alloy 0.050 inches in diameter in the solution treated quenched condition was cold drawn to 0.0025 inches in diameter which represents a cold working of 99.75% R.A. The wire was then stranded in a 19 end 1-6-12 concentric construction and annealed at 880° F. for 3 hours in a reducing atmosphere and furnace cooled to room temperature.

TABLE 3.1

| | Conventional | Modified |
|---|---|---|
| Tensile Strength (psi) | 87,535 | 97,570 |
| Conductivity (% IACS) | 60.4 | 65.2 |
| Elongation (% in./10 in.) | 8 | 9 |

As seen in Table 3.1 utilizing the modified process with cold working in excess of 99% R.A. results in a significant increase in both the tensile strength and conductivity of 11.5% and 7.9% respectively.

What is claimed is:

1. A method for manufacturing a wire from a copper precipitation hardenable alloy wherein the alloy consisting essentially of about 0.38% beryllium, 1.66% nickel and the remainder copper, said method comprising one or more processing steps and characterized in that said steps conclude with cold working the alloy to a wire and to an area reduction of at least 99% followed by precipitation heat treatment at a temperature of 750°–950° F. for a period of 1–4 hours and wherein the resulting wire has a tensile strength of at least 95,000 psi and an electric conductivity of at least 60% IACS.

2. A method of claim 1 wherein said cold working of at least 99% R.A. is performed directly without prior wire surface treatment or an intermediate annealing process.

3. A method of claim 1 wherein said precipitation heat treatment takes place in a furnace at a temperature of about 880° F. for a time of about 3 hours.

4. A method of claim 1 wherein said processing steps comprise heating said alloy to the solution annealing temperature of 1650°–1800° F. at which most elements of the alloy would be in solution and rapidly quenching said alloy to about room temperature.

5. A method of claim 4 wherein said processing steps further include plating said alloy with nickel or silver.

* * * * *